United States Patent [19]

Shimono et al.

[11] Patent Number: 4,575,223

[45] Date of Patent: Mar. 11, 1986

[54] BRAKING MECHANISM FOR DOCUMENT TABLE DRIVE MEANS IN A COPYING APPARATUS

[75] Inventors: Mamoru Shimono, Yokohama; Satoshi Yokomori; Kouji Yukinaga, both of Tokyo, all of Japan

[73] Assignees: Kabushiki Kaisha Toshiba; Toshiba Automation Engineering, Ltd., both of Kawasaki, Japan

[21] Appl. No.: 659,548

[22] Filed: Oct. 10, 1984

[30] Foreign Application Priority Data

Oct. 21, 1983 [JP] Japan ..... 58-197237
Apr. 28, 1984 [JP] Japan ..... 59-86583

[51] Int. Cl.[4] ..... G03G 15/28
[52] U.S. Cl. ..... 355/8; 355/3 R
[58] Field of Search ..... 355/8, 3 R, 3 DR, 11

[56] References Cited

U.S. PATENT DOCUMENTS 3,997,262 12/1976 Doi et al. ..... 355/3 R
4,465,359 8/1984 Nakahata ..... 355/8 X

FOREIGN PATENT DOCUMENTS 0164352 12/1981 Japan ..... 355/3 R

*Primary Examiner*—R. L. Moses
*Attorney, Agent, or Firm*—Cushman, Darby & Cushman

[57] ABSTRACT

Disclosed is an image forming apparatus of shell type which is divided into an upper unit and a lower unit, said upper unit being made rockable with respect to the lower unit and slidably provided with a document tale intended to have a document placed thereon. To the document table, there is connected a driving mechanism which is intended to cause the document table to slide with respect to the upper unit. This driving mechanism is provided with a braking mechanism which is intended to cause a braking force to act on the document table at the time when the upper unit is rocked with respect to the lower unit. The braking force of this braking mechanism acts to prevent the document table from being impulsively allowed to fall when the upper unit has been rocked.

12 Claims, 11 Drawing Figures

BRAKING MECHANISM FOR DOCUMENT TABLE DRIVE MEANS IN A COPYING APPARATUS

BACKGROUND OF THE INVENTION

The present invention relates to an image forming apparatus of the so-called "shell type" whose main body is divided into an upper unit and a lower unit and, more particularly, to an image forming apparatus arranged to move a document table upon which an original document is placed and thereby scan the image information of the document.

An image forming apparatus of the so-called "shell type" is generally known as one type of an image forming apparatus arranged to form an image of an original document onto a sheet of paper in accordance with the image information from the document. It is arranged such that its main body is divided into an upper unit and a lower unit and is made openable by rocking the upper unit with respect to the lower unit in order to make the maintenance and jam elimination easy.

Further, an image forming apparatus of the type wherein an original document is scanned by the formed and backward movement of a document table having this original document placed thereon is known as one of the above-mentioned image forming apparatuses of the "shell type". In this type of image forming apparatus, a driving mechanism for driving the document table is provided, which is intended to move the document table in the forward and backward directions. This driving mechanism is such that at the time of scanning the document the document table is forwardly moved and, when the document table is brought back to its original position after the scanning, is backwardly moved. Conventionally, with regard to this type of image forming apparatus, it was possible that when the main body is opened or closed for the purpose of performing the maintenance and jam elimination, the document table is caused to incline and thereby caused to slide or slip down. In order to prevent the document table from slipping, conventionally, the apparatus is provided with a locking mechanism which permits the document table to be locked at the time of opening the main body, or alternatively provided with a mechanism which permits the main body to be opened only when the document table is located at its lowermost position.

The above-mentioned known image forming apparatus, therefore, has a drawback in that it is complicated in construction and high in manufacturing cost.

SUMMARY OF THE INVENTION

The object of the present invention is to provide an image forming apparatus which, by use of an inexpensive and simple construction, makes it possible to prevent the document table from being allowed to slip down when its main body has been opened.

According to one aspect of the present invention, there is provided an image forming apparatus for forming an image in accordance with the image information of an original document. The apparatus comprises a main body having an image forming function and being divided into an upper unit and a lower unit, the upper unit being made rockable with respect to the lower unit; a document table slidably provided on the upper unit and intended to have a document placed thereon; and a driving means for causing the document table to slide on the upper unit in order to cause a document placed on the document table to be scanned at the time of forming its image, the driving means having a braking means which causes a braking force to act on the document table when the upper unit has been rocked with respect to the lower unit.

DETAILED DESCRIPTION OF THE PREFERRED EMBODIMENTS

An embodiment of the present invention will now be described in detail with reference to FIGS. 1 to 11 of the appended drawings.

Figure 1:
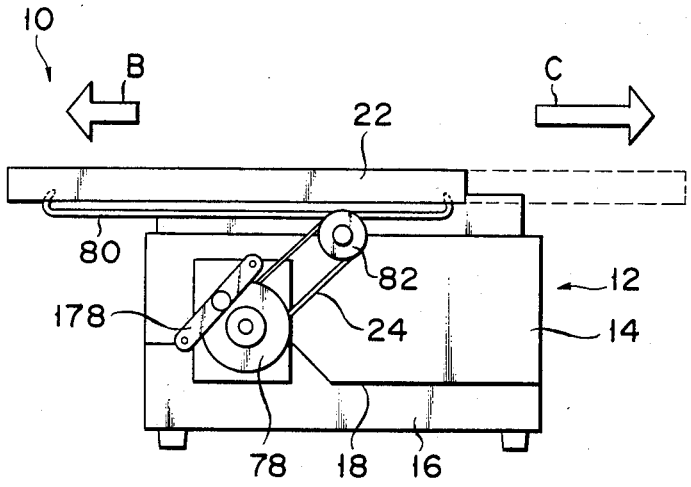
FIG. 1 is a front view schematically showing a copying apparatus according to an embodiment of the present invention.
Figure 2:
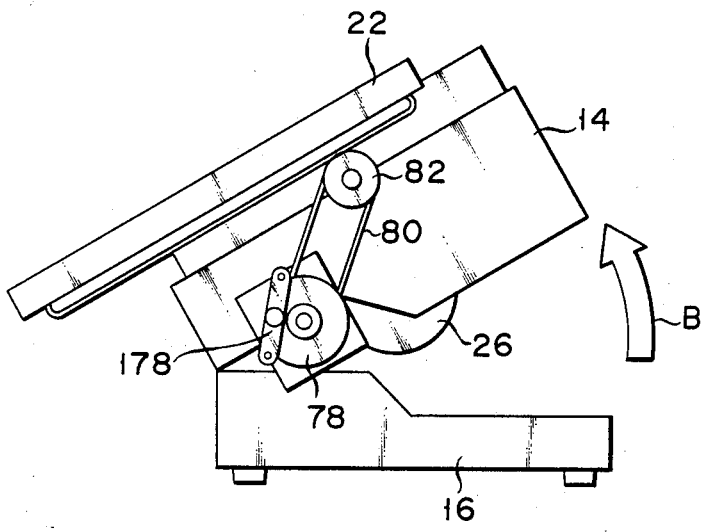
FIG. 2 is a front view showing a state wherein the copying apparatus shown in FIG. 1 is opened.

As shown in FIGS. 1 and 2, the main body 12 of an electronic copying machine 10 of the so-called "shell type", which constitutes an image forming apparatus according to the embodiment of the present invention, is divided into two parts, i.e., upper unit 14 and lower unit 16, by a dividing surface 18 formed at its substantially central portion. The dividing surface 18 is formed along a conveyance path permitting a copying paper P to be conveyed therealong, so that this conveyance path, where a jam is likely to occur, may be exposed when the main body 12 is opened. The upper unit 14 and the lower unit 16 are pivotally supported at their respective opposing one-side ends 20 through supporting shafts (not shown). That is, the upper unit 14 is constructed so as to be rockable with respect to the lower unit 16 as shown in FIG. 2 by an arrow B. The angle through which the upper unit 14 can be rocked, according to this embodiment, is set at, for example, approximately 30°.

On the top of the upper unit 14, a document table 22, on which a document (not shown) to be copied is placed, is provided in such a manner that it is slidable on the upper surface of the upper unit 14 substantially in parallel with this surface. The document table 22 is connected to a driving mechanism (driving means) 24, as later described in detail, and is reciprocatingly moved on the upper surface of the upper unit 14 by being driven by the driving mechanism 24 in the directions indicated in FIG. 1 by arrows B and C. When the document placed on the document table is subjected to exposure, the document table 22 is forwardly moved, i.e., caused to slide in the direction indicated by the arrow B. On the other hand, when the document is brought to its original position after it has been exposed, the document table 22 is backwardly moved, i.e., caused to slide in the direction indicated by the arrow C. In this embodiment, at the time of forward movement (exposure), the document table 22 is moved with a speed of V, while at the time of backward movement, it is moved with a speed of 2 V.

Figure 3:
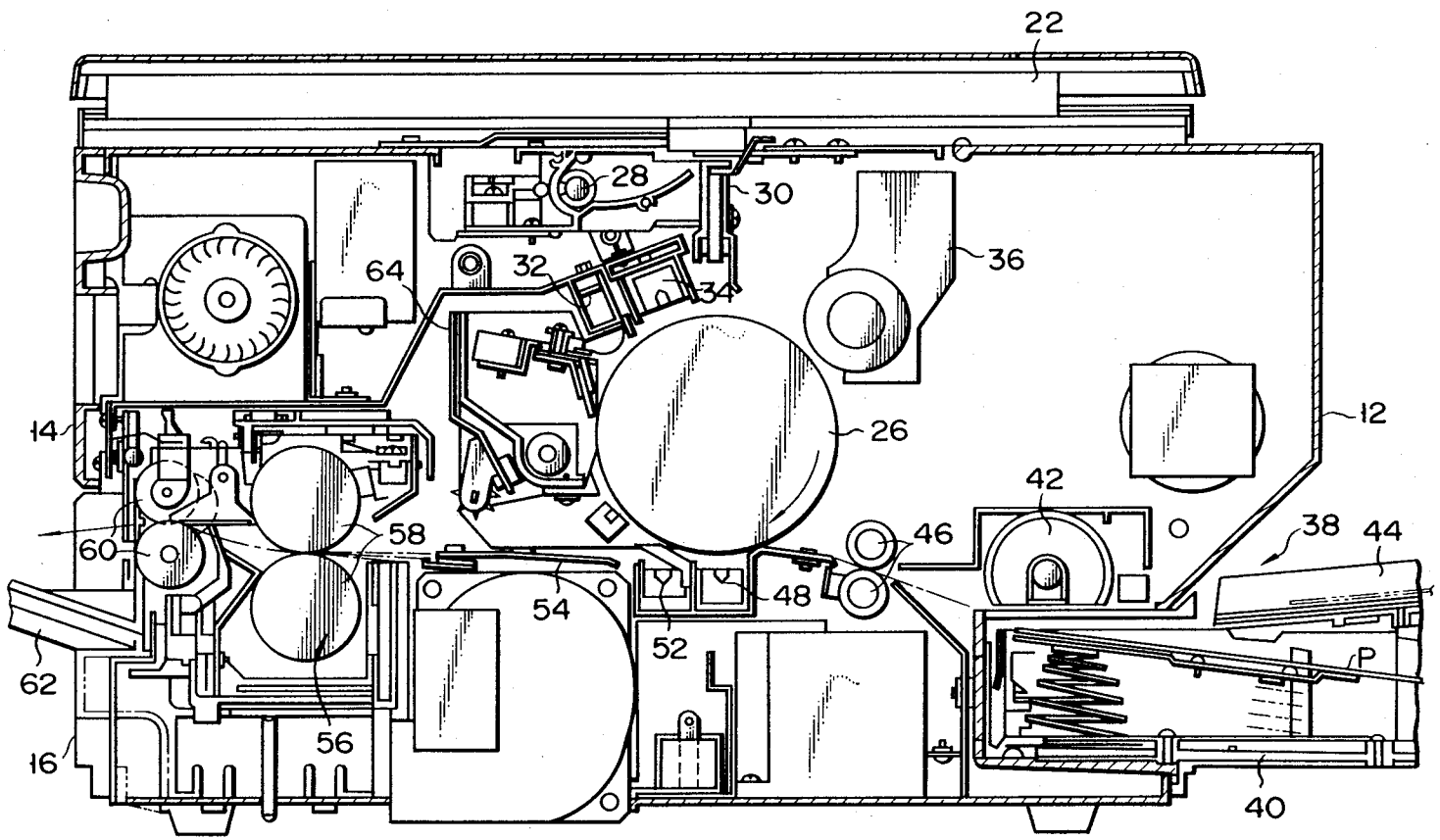
FIG. 3 is a sectional view schematically showing the internal structure of the copying apparatus shown in FIG. 1.

The interior construction of the main body 12 will now be described with reference to FIG. 3. In the substantially central part of the main body 12, there is rotatably disposed an image carrying body on whose surface is formed an electrostatic latent image, that is, a drum-shaped photosensitive material body 26 which consists of, for example, selenium. Around the photosensitive body 26, there are disposed a lamp 28 and a converging light-transmission material 30 which optically scan the document placed on the horizontally, reciprocally moving document table 22 to cause an image of the document to be focussed onto the surface of the photosensitive body 26 and then to cause an electrostatic latent image to be formed thereon. There is also disposed an electric discharge lamp 32, which is intended to cause the surface of the photosensitive body 26 to be electrically discharged before the document image is focussed thereto, as well as an electric charger 34, which is intended to cause the surface of the photosensitive body 26 to be electrically charged with uniformity after the same has been electrically discharged. A developing device 36 is further disposed, which is intended to apply a developer onto the electrostatic latent image formed on the surface of the photosensitive body 26 to thereby develop such a latent image.

At one side (the illustrated right-side portion) of the main body 12, a paper feeding section 38 is provided, which includes a paper feeding cassette 40 made detachable from, for example, its one side, a paper feeding roller 42 arranged such that it is brought into rolling contact with the uppermost copying paper sheet P received in the paper feeding cassette 40 to feed it into the main body 12, and a finger-insertion paper feeding guide 44 for feeding the copying paper sheets by insertion thereof with the fingers. Each sheep P delivered from the paper feeding section 38 is regulated for feed timing by a pair of aligning rollers 46, and fed so as to be in rolling contact with the photoconductive drum 26 in a transfer section. Around the photosensitive body 26, there are also disposed a pre-transfer charger 48, a transfer charger 48 for transferring onto the copying paper a developer which forms a visible image, and a peeling or removing charger 52 for removing the paper from the photosensitive body 26 after the developer has been transferred. The paper which has been transferred with the developer image (visible image) is guided to a fixing device 56 by a conveyance guide 54. The developer is fixed by the pressure and heat of a heat roller pair 58 constituting the fixing device 56. The paper thus fixed is, thereafter, discharged into a tray 62 by way of a paper-discharging roller pair 60. It should be noted here that the developer, which has remained on the surface of the photosensitive body 26 after the transfer operation, is eliminated by a cleaning means 64. It should also be noted here that a one-dot chain line appearing in FIG. 3 indicates the conveyance path along which the paper P is to be conveyed, and that the upper unit 12 is made openable from the lower unit 14 by using the conveyance path as the dividing surface, or an opening surface.

Figure 4:
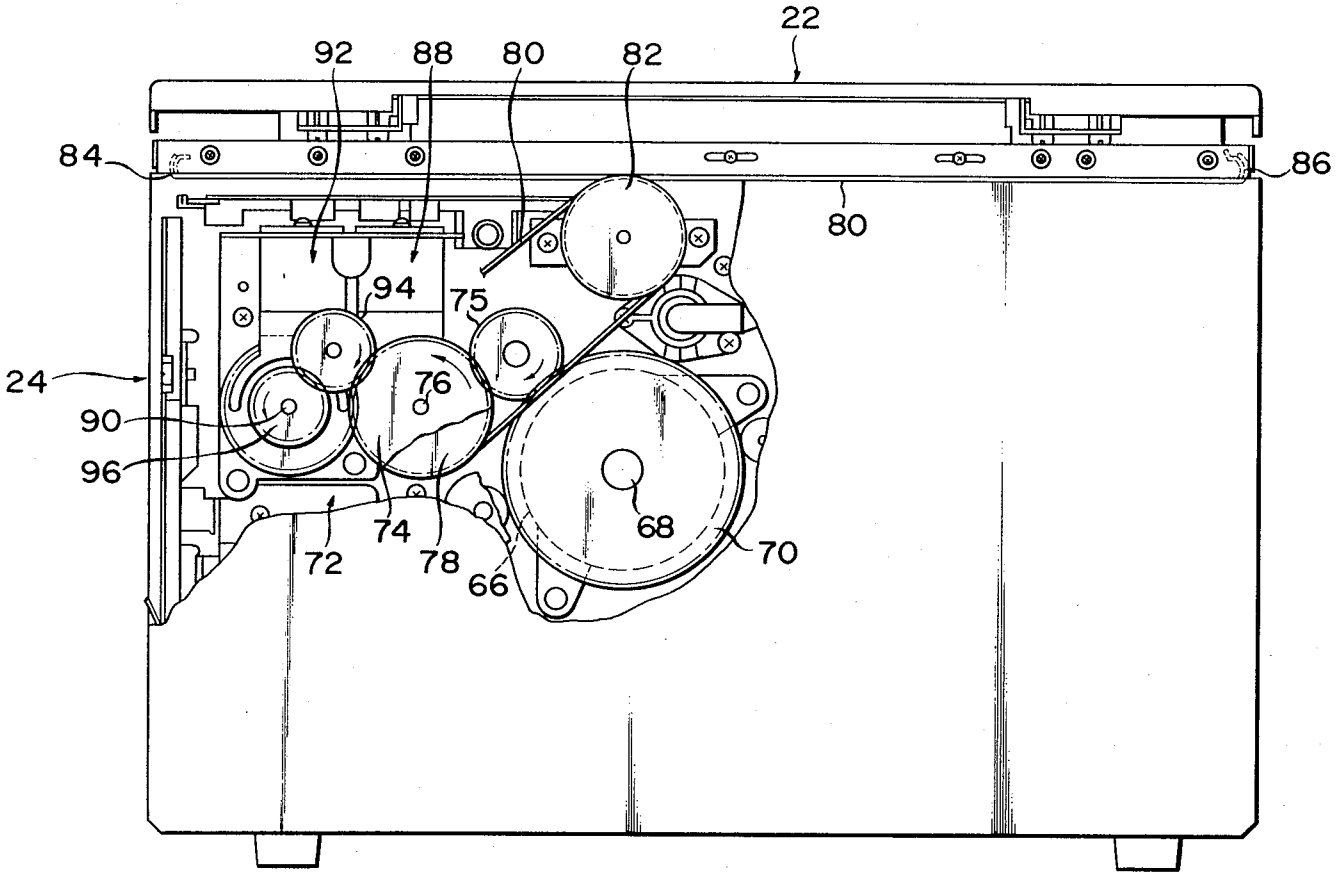
FIG. 4 is a partial front view which schematically shows a main part of a driving mechanism, which drives a document table, incorporated in the copying apparatus shown in FIG. 1.
Figure 5:
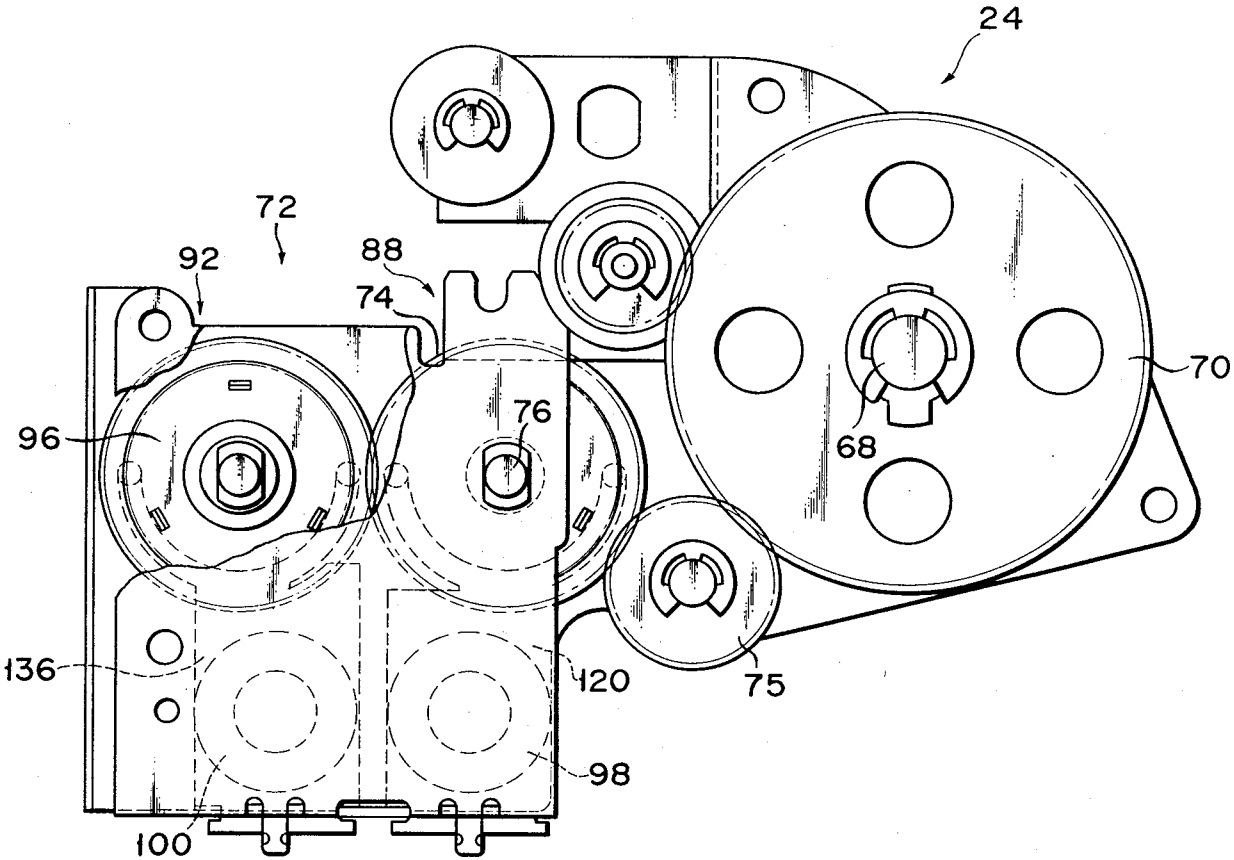
FIG. 5 is a front view schematically showing a clutch mechanism of the driving mechanism shown in FIG. 4.
Figure 6:
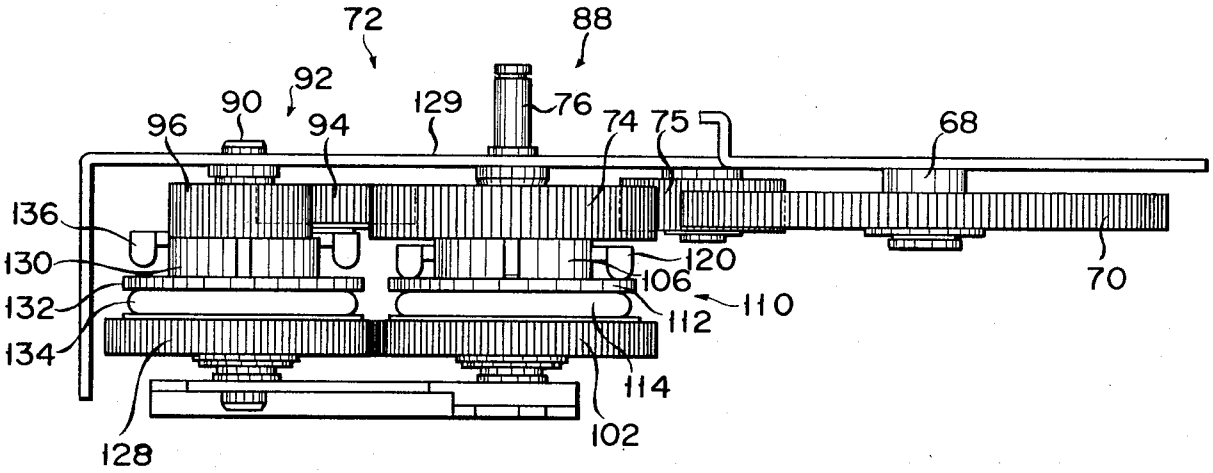
FIG. 6 is a schematic side view of the clutch mechanism shown in FIG. 5.

The above-mentioned driving mechanism 24 for causing the document table 22 to make its reciprocating and substantially horizontal movement will now be described with reference to FIGS. 4 to 6. In this driving mechanism 24, a motor 66 (indicated in broken lines), serving as a driving source, is connected to a driving gear 70 through a driving shaft 68 of the motor 66. The driving gear 70 is connected through a gear 75 to a first input gear 74 of a clutch mechanism (as later described in detail) 72, which is intended to control the direction of movement (reciprocating movement) of the document table 22 as well as the speed with which the document table 22 is moved. The first input gear 74 is connected to an output shaft 76 in a state wherein it is set free from the same. An output pulley 78 is also connected to the output shaft 76 coaxially with the first input gear 74. Around this output pulley 78, there is wound a table wire 80, which is intended to transmit a driving force to the document table 22. The ends 84 and 86 of this table wire are fixed to a forward end (the illustrated left-side end) and backward end of the document table 22 through a pulley 82, respectively. The table wire 80 is wound in such a manner that its portions intersect each other at the pulley 82, and its ends 84 and 86 are extended therefrom along the document table 22 substantially in parallel with the same. Though not shown, at the forward end portion 84 of the document table 22, a spring is mounted on the one end 84 of the table wire 80 which is fixed thereat; the spring is intended to lessen the shock of an impact produced in driving and controlling the document table 22. The clutch mechanism 72 is, as shown in FIG. 6, composed of a first clutch unit 88 provided on the output shaft 76, and a second clutch unit 92 provided on a shaft 90 extended substantially in parallel with the output shaft 76.

The second clutch unit 92 is provided for the purpose of changing over the rotational direction of the output pulley 78, in other words, changing over the forward movement to the backward movement, or vice versa, of the document table 22. Between the first clutch unit 88 and the second clutch unit 92, a gear 94 is interposed, whereby the rotation of the first input gear 74 of the first clutch unit 88 is transmitted to a second input gear 96 of the second clutch unit 92.

In the first clutch unit 88 and second clutch unit 92, a first solenoid 98 and a second solenoid 100 are provided, respectively, which are intended to be used for effecting the clutch connection and disconnection.

Figure 7:
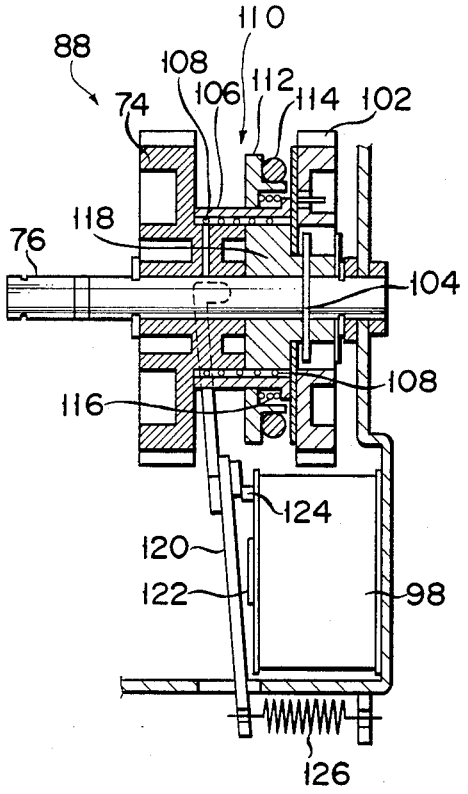
FIG. 7 is a sectional view of a clutch unit constituting the clutch mechanism shown in FIG. 6.

As shown in FIG. 7, in the first clutch unit 88, a first driven gear 102 is fixed to a lower portion of the first output shaft 76 by means of a pin 104. Accordingly, if this driven gear 102 is caused to rotate, the resulting rotational force will be directly transmitted to the first output shaft 76. On the other hand, since, as stated before, the first input gear 74 is connected to the output shaft 76 in a state wherein it is set free therefrom, its rotational force is not directly transmitted to the output shaft 76. Between the first input gear 74 and the first driven gear 102, a first cylindrical sleeve 106, inside which there is disposed a first coil spring 108, is rotatably mounted. One end of this first coil spring 108 is fixed to the first driving gear 74, and the other end thereof is fixed to the first sleeve 106. Onto the first sleeve 106, a first clutch device 110 is fitted in such a manner that it is movable in the axial direction of the first clutch unit 88. The first clutch device 110 has a friction plate 112 and a rubber ring 114 fitted to that side of the friction plate 112 which faces the first driven gear 102. Between the friction plate 112 and a lower end portion (residing on the side of the first driven gear) of the sleeve 106, there is mounted a return spring 116, by which the friction plate 112 is urged toward the input gear 74. Between the output shaft 76 and the sleeve 106, a boss 118 is interposed.

Between the first friction plate 112 and the first input gear 74, a first pressing plate 120 is disposed, which is intended to press the friction plate 112 onto the first driven gear 102 against the urging force of the return spring 116 to cause the former to contact with the latter. The first pressing plate 120 is disposed such that its base end portion is rockable and is located close to the first solenoid 98, so the first pressing plate 120 may be operated due to the excitation of the first solenoid 98. The first solenoid 98 is provided, at its side which opposes the first pressing plate 120, with an attractive section 122 which is intended to electromagnetically attract the pressing plate 120, and is also provided with a stopper 124 which is intended to stop the movement of the first pressing plate 120 at a specified position thereof. The pressing plate 120 is connected, at its one end, with a spring 126 which is intended to urge the pressing plate 120 in a direction which causes it to go away from the first solenoid 98.

According to the above-mentioned construction of the first clutch unit 88, the rotational force of the first input gear 74 is transmitted to the first friction plate 112. When, thereafter, the first solenoid 98 is excited, the first pressing plate 120 is operated with the result that the first friction plate 112 and the first driven gear 102 are connected together through the action of the resulting frictional force. The boss 118 is wound by the first coil spring 108 in tight, thereby generating torque between them. As a result, the first driven gear 102 is caused to rotate by the torque. The rotational force of this first driven gear 102 is transmitted intact to the output shaft 76 since the former gear is fixed to the latter shaft.

The second clutch unit 92 is, as shown in FIG. 6 constructed in substantially the same manner as that in which the first clutch unit 88 is constructed. That is to say, at a lower portion of the shaft 90, a second driven gear 128 meshed with the first driven gear 102 is fixed to the shaft 90 by means of a pin (not shown). As in the first clutch unit 88, between the second input gear 96 and the second driven gear 128, a second sleeve 130, a second friction plate 132, a rubber ring 134 and a second pressing plate 136 are disposed. As in the first clutch unit 88, when the second solenoid 100 is excited, the second pressing plate 136 is operated with the result that the second friction plate 132 and the second driven gear 128 are connected together by the action of the resulting frictional force. Consequently, the rotational force of the second input gear is transmitted to the second driven gear 128 as in the first clutch unit 88. Since the second driven gear 128 is meshed at all times with the first driven gear 102, the rotational force transmitted to the second driven gear 128 is transmitted to the output shaft 76 through the first driven gear 102. It should be noted here that the reference numeral 129 in FIG. 6 denotes a supporting plate which is intended to support the clutch mechanism 72.

The operation of this clutch mechanism 72 will now be explained with reference to FIGS. 4 and 6. When the motor 66 is driven to rotate, the driving gear 70 is caused to rotate in one direction, e.g, in the counterclockwise direction. The first input gear 74 is caused to rotate, through the gear 75, in the same direction as that in which the driving gear 70 is caused to rotate, i.e., in the counterclockwise direction. On the other hand, since the second input gear 96 is meshed with the first input gear 74 through the gear 94, this second input gear 96 is caused to rotate in the same direction as that in which the first input gear 74 rotates, i.e., in the counterclockwise direction.

When the first solenoid 98 is excited, or turned on, and the second solenoid 100 is turned off, since the rotational force of the first input gear 74 is transmitted intact to the driving shaft 76 through the first driven gear 102, the driving shaft 76 is caused to rotate in the counterclockwise direction. On the other hand, the second input gear 96 makes its free rotation, and this rotational force is not transmitted anywhere.

When the second solenoid 100 is excited, or turned on, and the first solenoid 98 is kept off, the rotation force of the second input gear 96 is transmitted to the second driven gear 128. Accordingly, this second driven gear 128 is caused to rotate in the counterclockwise direction, so the first driven gear 102 meshed with this second driven gear 128 is caused to rotate in the clockwise direction. Accordingly, the output shaft 76 is caused to rotate in the clockwise direction. In this case, the first input gear 74 is allowed to make its free rotation, and its rotational force is not transmitted to the output shaft 76. As mentioned above, according to the construction of the clutch mechanism 72, it is possible to change the direction of rotation of the output shaft 76 by selectively exciting the solenoid 98 or 100. Since the rotational force of this output shaft 76 is transmitted to the table wire 80 through the output pulley 78, the document table 22 is horizontally, reciprocatingly moved. For instance, in this embodiment, when the output shaft 76 is rotated in the counterclockwise direction, the document table 22 is forwardly moved (in the direction indicated in FIG. 1 by the arrow B). When the output shaft 76 is rotated in the clockwise direction, the document table 22 is backwardly moved (in the direction indicated in FIG. 1 by the arrow C).

Figure 8:
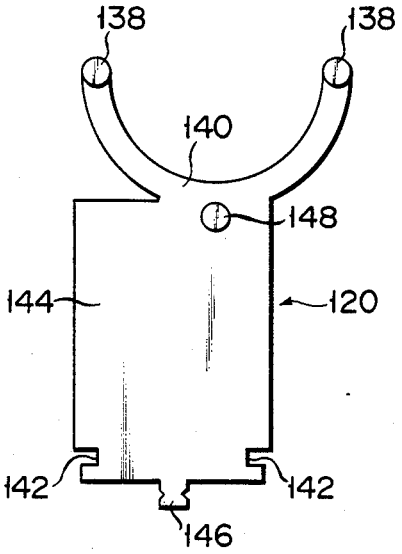
FIG. 8 is a front view of a pressing plate used for the clutch unit shown in FIG. 7.
Figure 9:
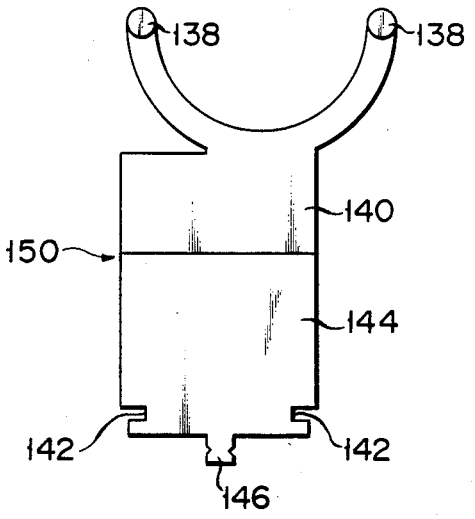
FIG. 9 is a front view of a modification of the pressing plate shown in FIG. 8.

The first and second pressing plate 120 and 136 will now be described in detail with reference to FIG. 8. In this case, however, since both plates 120 and 136 are of substantially the same shape, a detailed description of the second pressing plate 136 is omitted by describing the first pressing plate 120 in detail. The first pressing plate 120 has a distal end portion 140 shaped like a letter U and provided with projections 138 used to press the friction plate 112, and has a proximal end portion 144 formed with notches 142 intended to be used to permit the proximal end portion 144 to be engaged in the proximity of the solenoid 98. The proximal end portion 144 is formed with a projection 146 intended to be engaged with one end portion of the above-mentioned spring 126 (See FIG. 7). Between the distal end portion 140 and the proximal end portion 144, a stopping projection 148 is formed and protrudes to abut against the stopper 124 (See FIG. 7) of the solenoid 98. In this embodiment, at least the distal end portion 140 of the pressing plate 120, which is disposed such that it opposes the clutch unit 88, is formed of elastic material, for example, spring material. It should be noted here that the projections 138 and 148 are formed of plastic material. In FIG. 9, a modification 150 is shown of the first pressing plate 120 shown in FIG. 8. In this pressing plate shown in FIG. 9, a boundary is formed between the distal end portion 140 and the proximal end portion 144, i.e., at a substantially central line of the pressing plate 150. The distal end portion 140 is formed of plastic material as an elastic material, and the proximal end portion 144 is formed of iron material which is magnetizable. In this way, since at least a part of the pressing plate is formed of elastic material, it can be elastically contacted with the friction plate 112 of the clutch unit 88. Accordingly, it is possible to increase the pressure-contacting force which acts on the friction plate in effecting the clutch connection.

Figure 10:
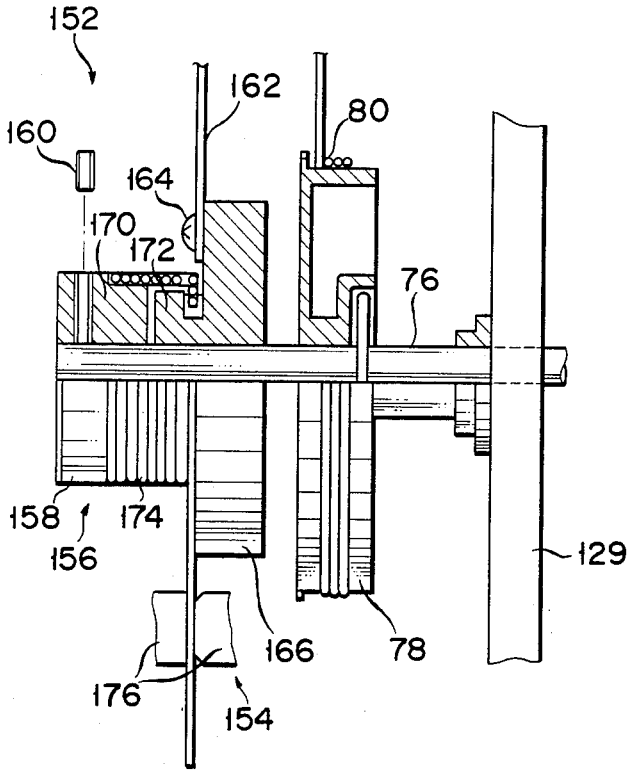
FIG. 10 is a side view, in section, of a braking mechanism provided on the driving mechanism shown in FIG. 4.
Figure 11:
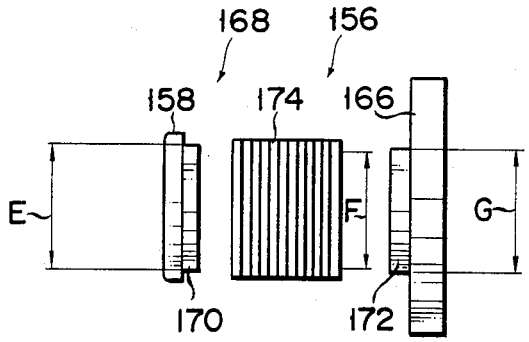
FIG. 11 is a side view of the braking mechanism, partly dismembered, shown in FIG. 10.

A braking unit 152 for applying a braking force to the movement of the document table 22 will now be described in detail with reference to FIGS. 10 and 11. As shown in FIG. 10, the braking unit 152 is disposed at a tip end portion of the output shaft 76 in such a manner that it is coaxial with the output pulley 78 wound with the above-mentioned table wire 80. The braking unit 152 includes a first braking mechanism 154 and a second braking mechanism 156, which apply their respective different braking forces as later described in detail. In the braking unit 152, a hub 158 is fixed to the tip end portion of the output shaft 76 by means of, for example, screws 160. Between the hub 158 and the output pulley 78, a boss 166, to which a braking plate 162 is fixed by means of, for example, screws, is mounted on the output shaft 76 in such a manner that it is made free from the shaft 76. Between the hub 158 and the boss 166, a one-way clutch 168 is provided which serves as the second braking mechanism 156. As shown in FIG. 11 in detail, the one-way clutch 168 is composed of a stepped portion 170 formed on the hub 158, a stepped portion 172 formed on the boss 166 so as to face the stepped portion 170, and a spring 174 fitted onto the outer periphery of each stepped portion 170 and 172. The inner diameter F of the winding of the spring 174 is made slightly smaller than the respective outer diameters E and G of the stepped portions 170 and 172. Therefore, both ends of the spring are mounted on the stepped portions 170 and 172, respectively, in a state wherein they are closely fitted thereto. One end of the spring 174 is fixed to the boss 166, while the other end thereof is only inserted over the stepped portion 170 of the hub 158. According to this construction of the one-way clutch 168, when the output shaft 76 is caused to rotate in the same direction as that in which the spring 174 winds, for example, in the counterclockwise direction (when the document table 22 is moved in the forward or exposure direction B as shown in FIG. 1), the other end of the spring 174 is fastened onto the stepped portion 170 of the hub 158. As a result, since the hub 158 and the boss 166 are connected to each other, the boss 166 is caused to rotate jointly with the hub 158. On the other hand, when the output shaft 76 is caused to rotate in the clockwise direction (when the document table 22 is returned to its original position, i.e., it is moved in the direction indicated by arrow C), since the spring wound around the stepped portion 170 of the hub 158 is loosened, the hub 158 is not connected to the boss 166. As a result, the rotational force does not act on the boss 166. In this case, however, a slide resistance is produced between the stepped portion 170 of the hub 158 and the spring 174. This slide resistance, which acts as the second braking force, keeps the constant speed with which the document table 22 is moved in the backward direction (the direction indicated in FIG. 1 by arrow C). The second braking force can be set at any given value by optionally combining the outer diameter G of the stepped portion of the boss and the inner diameter F of the winding of the spring 174.

On the other hand, the first braking mechanism 154 includes the braking plate 162, which is shaped like a disc and onto which a pair of pads 176 for applying the first braking force are provided in such a manner that they sandwich the braking plate 162. The paired pads 176 are supported by the supporting member 178 shown in FIGS. 1 and 2, so they can be pressed against the braking plate 162. When the paired pads 176 are pressed against the braking plate 162, the first braking force acts on the boss 166, in other words, the document table 22. The first braking force acts to prevent the document table 22 from being allowed impulsively to fall at the time when the main body 12 has been opened as indicated in FIG. 2. At the same time, the first braking force also keeps the constant speed of movement of the document table 22 at the time of exposure (scanning). Needless to say, the force with which the paired pads 176 clamp the braking plate 162 is previously set at any given value. As stated above, according to the first braking force, it is possible to prevent the document table 22 from being allowed to impulsively fall when the main body 12 has been opened and, at the same time, to reduce the vibration of the document table 22 due to its being driven until it arrives at the forward end of a document image in its exposure process (forward movement).

On the other hand, the second braking force is set at a value capable of preventing the document table 22 from being impulsively stopped when its backward movement is completed.

In this embodiment, where the outer diameter of the stepped portion 170 of the hub 158 is set at a value of $14\pm0.01$ mm and the inner diameter B of the spring 174 is set at a value of $13.6\pm0.05$ mm, the first braking force is set at a load torque of 1 Kg-cm with respect to the output shaft 76, and the second braking force is set at a load torque of 0.36 Kg-cm with respect thereto. As a result, when the document table 22 is moved backwards, a braking force having a magnitude equal to $\frac{1}{3}$ of that which acts when the document table 22 is moved forward is imparted to the output shaft 76.

When the output shaft 76 is caused to rotate in the counterclockwise direction to move the document table 22 forwards, the hub 158 is caused to rotate integrally with the output shaft 76. By this rotation of the hub 158, the spring 174 is fastened, due to the slide resistance, onto the hub 158 and the boss 166. As a result, the rotational force of the hub 158 is transmitted to the braking plate 162, so that this plate is caused to rotate. By pressing this braking plate 162 by the paired pads 176, the first braking force is imparted to the output shaft 76 to control the movement of the document table 22, thereby reducing its vibration during its movement.

Further, when the document table 22 is moved backwards, the output shaft 76 is caused to rotate in the clockwise direction to loosen the winding of the spring 174. At this time, although the spring 174 and the boss 166 are prevented from being rotated by the fastening force of the paired pads 176, the second braking force, resulting from the slide resistance produced between the hub 158 and the spring 174, is imparted to the rotational force of the output shaft 76 or output pulley 78.

According to this embodiment, since the first braking force and the second braking force, which is different in magnitude from this first braking force, are imparted during the forward and backward movements of the document table 22 respectively, the torque of the output shaft 76 at the time of the forward movement of the document table 22 can be set independently of that of the output shaft 76 at the time of the backward movement of the document table 22.

On the other hand, at the time when the interior of the main body 12 is inspected, for example, the upper unit 14 is opened as shown in FIG. 2. At this time, the first braking force is applied to the document table 22 by the above-mentioned braking unit. That is to say, at this time, the document table 22 is allowed to slip down, so the output shaft 76 is counterclockwise rotated through the table wire 80 and the output pulley 78. By this rotation of the output shaft 76, the hub 158 is caused to rotate and as a result the spring 174 is fastened as when the document table 22 is forwardly moved. Thus, the first braking force is applied to the output shaft 76.

According to the present invention, it is possible, with a simple construction and at a low cost, to provide an image forming apparatus which makes it possible to reliably prevent the document table 22 from impulsively slipping down when the main body 12 is opened.

The present invention is not limited to the above-mentioned embodiment, and various modifications can be made without departing from the spirit and scope of the invention.

For instance, in the above-mentioned embodiment, description was made of a copying apparatus, but the present invention is not limited thereto. Namely, the same effect is obtained even when the invention is applied to an apparatus wherein the image information is converted into an image signal, which is transmitted.

In the above-mentioned embodiment, the driving mechanism was so constructed that the first and second braking forces can act, but the present invention is not limited thereto. Namely, the driving mechanism may also be such that the only working mechanism is that which is intended to prevent the falling of the document table when the main body is opened, i.e., only the first braking mechanism.

In the above-mentioned embodiment, the braking plate and the pair of pads used to clamp this braking plate were used as the constituent elements of the first braking mechanism for imparting the first braking force, but the present invention is not limited thereto. Namely, many pads may be used. Or, in place of using pads, another braking plate is disposed such that it opposes one surface of the braking plate, thereby causing both plates to frictionally contact each other. By so doing, it is also possible to obtain the same effect as that which is attainable with the above-mentioned embodiment.

What is claimed is:

1. An image forming apparatus for forming an image in accordance with the image information of an original document, which comprises:

a main body having an image forming function, said main body being divided into an upper unit and a lower unit, said upper unit being made rockable with respect to said lower unit;

a document table slidably provided on said upper unit and intended to have said document placed thereon; and a driving means for causing said document table to slide on said upper unit in order to cause said document placed on said document table to be scanned at the time of forming its image, said driving means having a braking means which causes a braking force to act on said document table when said upper unit has been rocked with respect to said lower unit.

2. An image forming apparatus according to claim 1, wherein said driving means has an output shaft for transmitting a driving force to said document table, and a clutch mechanism for making effective and ineffective the transmission of a driving force being transmitted to said output shaft.

3. An image forming apparatus according to claim 2, wherein said clutch mechanism has two clutch units which are connected to each other in order that they may transmit a normal-rotational force and a reverse-rotational force to said output shaft in such a manner that when scanning said document said document table is moved so as to move in the direction of its fall when said upper unit has been rocked, and that when returning said document to its original position said document table is moved in the opposite direction.

4. An image forming apparatus according to claim 3, wherein said braking means includes a first braking mechanism which causes a first braking force to act when said output shaft is made to rotate normally so as to cause said document table to move in the direction of scanning said document, and a second braking mechanism which causes a second braking force smaller than said first braking force to act when said output shaft is made to rotate in the reverse direction.

5. An image forming apparatus according to claim 4, wherein said first braking mechanism includes a braking plate provided in a manner such that it is set free from said output shaft, and pads for applying a braking force to said braking plate; and said second braking mechanism includes a one-way clutch having a coil spring which, when said output shaft is made to rotate in the reverse direction, permits said braking plate to be connected to said output shaft to cause a rotational force to be applied to said braking plate, and which, when said output shaft is made to rotate in the normal direction, is only brought into contact with said output shaft.

6. An image forming apparatus according to claim 4, wherein said first braking mechanism is set so that a load torque of about 1 Kg-cm may act on said output shaft, and said second braking mechanism is set so that a load torque of about 0.36 Kg-cm may act on said output shaft, whereby the braking force, acting when said document table is moved in the direction of scanning said document, is set at a value which is about three times as great as that of the braking force acting when said document table is returned to its original position.

7. An image forming apparatus according to claim 3, wherein each of said two clutch units includes a driving source, one rotary member which is caused to rotate by the driving force transmitted from said driving source, a second rotary member which is provided as a separate member from said one rotary member and which is fixed to said output shaft, and a pressing plate which transmits the driving force of said driving source to said output shaft by bringing one of said rotary members into contact with the other.

8. An image forming apparatus according to claim 7, wherein each of said two clutch units includes a solenoid, said pressing plate having a magnetic material which is attracted to said solenoid when said solenoid is excited, whereby said pressing plate moves to bring said rotary members into contact.

9. An image forming apparatus according to claim 8, wherein at least a part of said pressing plate is formed of elastic material, and said pressing plate is prevented, due to an elastic force of its elastic portion, from being impulsively caused to abut against one of said rotary members.

10. An image forming apparatus according to claim 9, wherein a portion of said pressing plate which comes near to said solenoid is formed of magnetic material; and a portion of said pressing plate which abuts against one of said rotary members to press it is formed of elastic material.

11. An image forming apparatus according to claim 9, wherein said elastic material is plastic material.

12. An image forming apparatus according to claim 10, wherein said pressing plate is formed, substantially as a whole, of a spring material having magnetizability as well as elasticity.

* * * * *